US010517379B2

(12) United States Patent
Levy et al.

(10) Patent No.: US 10,517,379 B2
(45) Date of Patent: Dec. 31, 2019

(54) FASTENING ELEMENT FOR MAGNETICALLY FASTENING AN ELECTRONIC MODULE, SET COMPRISING SUCH A FASTENING ELEMENT AND AN ELECTRONIC MODULE

(71) Applicant: PARROT SHMATES, Paris (FR)

(72) Inventors: Olivier Levy, Paris (FR); Mélusine Pigeon, Paris (FR)

(73) Assignee: Wear TRBL, Paris (FR)

( * ) Notice: Subject to any disclaimer, the term of this patent is extended or adjusted under 35 U.S.C. 154(b) by 95 days.

(21) Appl. No.: 15/942,624

(22) Filed: Apr. 2, 2018

(65) Prior Publication Data

US 2018/0279751 A1 Oct. 4, 2018

(30) Foreign Application Priority Data

Apr. 4, 2017 (EP) ..... 17305407

(51) Int. Cl.
*A45F 5/02* (2006.01)
*A41F 1/00* (2006.01)
(Continued)

(52) U.S. Cl.
CPC ..... *A45F 5/02* (2013.01); *A41D 1/002* (2013.01); *A41F 1/002* (2013.01); *D02G 3/12* (2013.01);
(Continued)

(58) Field of Classification Search
CPC ..... A41D 27/085; A41D 1/002; A45F 5/02; A45F 2200/0525; G06F 1/1654;
(Continued)

(56) References Cited

U.S. PATENT DOCUMENTS 4,709,307 A * 11/1987 Branom ..... A41D 27/085 362/103
5,912,653 A * 6/1999 Fitch ..... G09F 9/35 345/7
(Continued)

FOREIGN PATENT DOCUMENTS

EP 3153045 A1 * 4/2017 ..... G06F 1/1654
JP 2007212906 A 8/2007
WO WO-2012100082 A2 * 7/2012 ..... A41D 1/002

OTHER PUBLICATIONS

Extended Search Report for European Application No. 17 30 5407 dated Sep. 19, 2017.

*Primary Examiner* — Jack W Lavinder
(74) *Attorney, Agent, or Firm* — Pearne & Gordon LLP

(57) ABSTRACT

This fastening element for magnetically fastening an electronic module is configured to be fixed to a support, the support having a recess, the electronic module including a radioelectric antenna and a display screen, the radioelectric antenna having a characteristic wavelength, the display screen being visible through the recess when the fastening element is fixed to the support and fastened to the electronic module, the fastening element being configured to be fixed around the recess, wherein the fastening element comprises several portions, at least some portions being separate from each other by a respective gap for emission and/or reception of radio waves by the radioelectric antenna, and wherein at least one portion has a length depending on the characteristic wavelength.

16 Claims, 2 Drawing Sheets

(51) Int. Cl.

| | |
|---|---|
| ***D02G 3/12*** | (2006.01) |
| ***A41D 1/00*** | (2018.01) |
| ***H01Q 1/27*** | (2006.01) |
| ***H01Q 9/28*** | (2006.01) |

(52) U.S. Cl.
CPC ..... *H01Q 1/273* (2013.01); *H01Q 9/285* (2013.01); *A45F 2200/0525* (2013.01); *D10B 2501/04* (2013.01)

(58) Field of Classification Search
CPC .. A41B 1/18; A41F 1/002; D02G 3/12; H01Q 1/273; H01Q 9/285; D10B 2501/04
See application file for complete search history.

(56) References Cited

U.S. PATENT DOCUMENTS

| | | | | |
|---|---|---|---|---|
| 2003/0213045 | A1 | 11/2003 | Fuentes | |
| 2010/0315367 | A1 | 12/2010 | Moy | |
| 2011/0122029 | A1 | 5/2011 | Bonwit et al. | |
| 2012/0137399 | A1* | 6/2012 | Forte ..... | A47G 1/0616 2/69 |
| 2014/0267940 | A1 | 9/2014 | Ackerman et al. | |
| 2016/0085294 | A1* | 3/2016 | Weiner ..... | G06F 1/1652 345/173 |
| 2017/0018843 | A1 | 1/2017 | Kourti et al. | |
| 2017/0079336 | A1 | 3/2017 | Hirschberg et al. | |

* cited by examiner

FASTENING ELEMENT FOR MAGNETICALLY FASTENING AN ELECTRONIC MODULE, SET COMPRISING SUCH A FASTENING ELEMENT AND AN ELECTRONIC MODULE

CROSS-REFERENCE TO RELATED APPLICATIONS

This application is a U.S. non-provisional application claiming the benefit of European Application No. 17 305 407.3, filed on Apr. 4, 2017, which is incorporated herein by reference in its entirety.

FIELD OF THE INVENTION

The present invention relates to a fastening element for magnetically fastening an electronic module, the fastening element being configured to be fixed to a support. The support has a recess and the electronic module includes a radioelectric antenna and a display screen, the display screen being visible through the recess when the fastening element is fixed to the support and fastened to the electronic module. The fastening element is configured to be fixed around the recess.

The invention also relates to a set comprising a support having a recess, such a fastening element fixed to the support and an electronic module magnetically fastened to the fastening element, the electronic module including a radioelectric antenna and a display screen, the display screen being visible through the recess.

The invention concerns the field of wearable wireless displays systems for displaying information, in particular images or videos.

BACKGROUND OF THE INVENTION

US 2003/213045 A1, US 2010/0315367 A1 and US 2014/0267940 A relate to electronic display systems adapted to be temporary and magnetically fastened to articles of clothing with magnets.

These electronic display systems allow displaying various images for the attention of people around the person who wears an article of clothing equipped with such an electronic display system. These electronic display systems include a wireless communication unit, which is useful for wirelessly receiving images to be displayed.

However, the wireless data communication with such systems is improvable.

SUMMARY OF THE INVENTION

A goal of the present invention is to propose a fastening element for magnetically fastening an electronic module and a set comprising such a fastening element and an electronic module magnetically fastened to the fastening element, wherein the data transmission is improved.

To this end, the invention relates to a fastening element for magnetically fastening an electronic module, the fastening element being configured to be fixed to a support, the support having a recess, the electronic module including a radioelectric antenna and a display screen, the radioelectric antenna having a characteristic wavelength, the display screen being visible through the recess when the fastening element is fixed to the support and fastened to the electronic module, the fastening element being configured to be fixed around the recess, wherein the fastening element comprises several portions, at least some portions being separate from each other by a respective gap for emission and/or reception of radio waves by the radioelectric antenna, and wherein at least one portion has a length depending on the characteristic wavelength.

According to other advantageous aspects of the invention, the fastening element comprises one or more of the following features taken alone or according to all technically possible combinations:

- several portions of the fastening element have a respective length depending on the characteristic wavelength;
- the length depending on the characteristic wavelength is the greatest length of the corresponding portion;
- the length depending on the characteristic wavelength is substantially equal to a quarter of the characteristic wavelength of the radio antenna;
- each portion with a length depending on the characteristic wavelength has a rectangular shape;
- the measure of each gap between two successive portions is comprised between 1 mm and 3 mm,
- preferably substantially equal to 2 mm;
- the fastening element is a metallic element,
- preferably a metallic yarn element.

The invention also relates to a set comprising a fastening element configured to be fixed to a support, the support having a recess; and an electronic module magnetically fastened to the fastening element, the electronic module including a radioelectric antenna and a display screen, the radio antenna having a characteristic wavelength, the display screen being visible through the recess, wherein the fastening element is as defined above.

According to other advantageous aspects of the invention, the set comprises one or more of the following features taken alone or according to all technically possible combinations:

- the portion(s) with a length depending on the characteristic wavelength is (are) the portion(s) closest to the radioelectric antenna;
- the portions of the fastening element are disposed around at least two sides of the recess;
- the electronic module is substantially planar and the length depending on the characteristic wavelength is the greatest length of the corresponding portion in a plane substantially parallel to the electronic module;
- the electronic module includes a magnetic frame for being magnetically fastened to the fastening element, the magnetic frame generating a magnetic field, and the fastening element is substantially perpendicular to the magnetic field generated by the magnetic frame;
- the set further comprises the support having the recess;
- the support is a yarn support,
- preferably a wearable article of clothing;

BRIEF DESCRIPTION OF THE DRAWINGS

The invention will be better understood upon reading of the following description, which is given solely by way of example and with reference to the appended drawings, in which.

DETAILED DESCRIPTION OF PREFERRED EMBODIMENTS

In the following of the description, the expression "substantially equal to" defines a relation of equality to plus or minus 10%, preferably to plus or minus 5%. The expression "substantially perpendicular to" corresponds to an angle of 90° to plus or minus 10°, preferably to plus or minus 5°.

Figure 1:
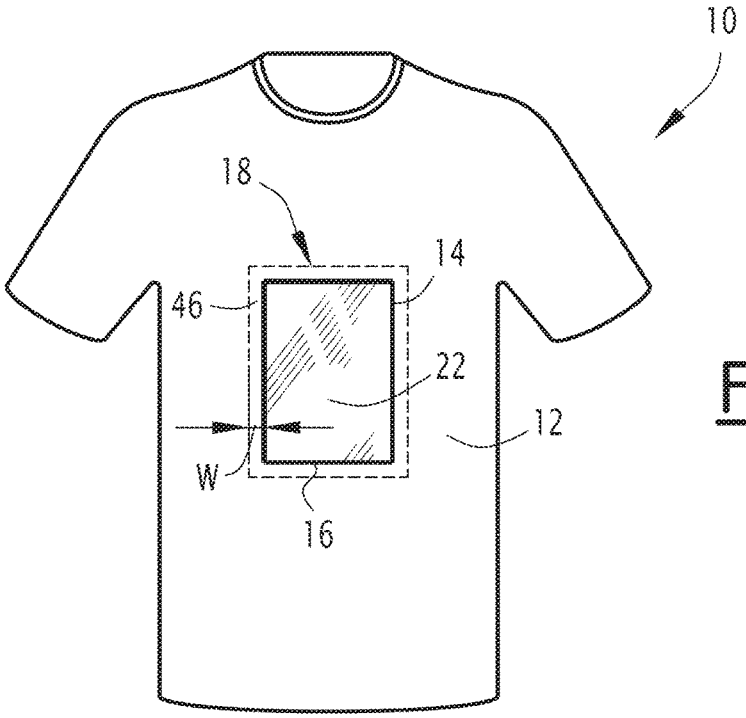
FIG. 1 is a schematic view of a set comprising a support, such as a wearable article of clothing, a fastening element fixed to the support, the support having a recess, and an electronic module magnetically fastened to the fastening element, the electronic module including a radioelectric antenna and a display screen, the radio antenna having a characteristic wavelength, the display screen being visible through the recess.

In FIG. 1, a set 10 comprises a support 12 having a recess 14, a fastening element 16 (also shown in FIGS. 2 and 4) fixed to the support 12 around the recess 14 and an electronic module 18 (also shown in FIGS. 3 and 4) magnetically fastened to the fastening element 16, the electronic module 18 including a radioelectric antenna 20 and a display screen 22, the radioelectric antenna 20 having a characteristic wavelength $\lambda_{antenna}$.

The support 12 is for example a yarn support. The support 12 is preferably a wearable article of clothing, such as a tee-shirt. Alternatively, the support 12 is a bag, such as a backpack.

The recess 14 is preferably made via a laser cutting so as to obtain a clear cutting, without fraying of the edge of the recess.

The fastening element 16 is configured for magnetically fastening the electronic module 18, the fastening element 16 being adapted to be fixed to the support 12. The fastening element 16 is also called attaching element and is configured for magnetically attaching the electronic module 18.

The magnetic fastening or attaching is as known per se a temporary fastening or attaching. Indeed, the fastening element 16 is adapted to be separated from the electronic module 18 further to a manual traction of a user between the fastening element 16 and the electronic module 18.

The fastening element 16 is, for example, a metallic element, preferably a metallic yarn element. When the support 12 is a yarn support and the fastening element 16 is a metallic yarn element, the fastening element 16 is preferably adapted to be sewn or glued on the support 12.

The fastening element 16 is configured to be fixed around the recess 14. The fastening element 16 has for example a frame shape, such as a rectangular shape.

The fastening element 16 comprises several portions 24, 26, 28, 30, 32, 34, 36, at least some portions 24, 26, 28, 30 being separate from each other by a respective gap 38, 40, 42 for emission and/or reception of radio waves by the radioelectric antenna 20. At least one portion 24, 26 has a length L1, L2 depending on the characteristic wavelength $\lambda_{antenna}$.

Figure 2:
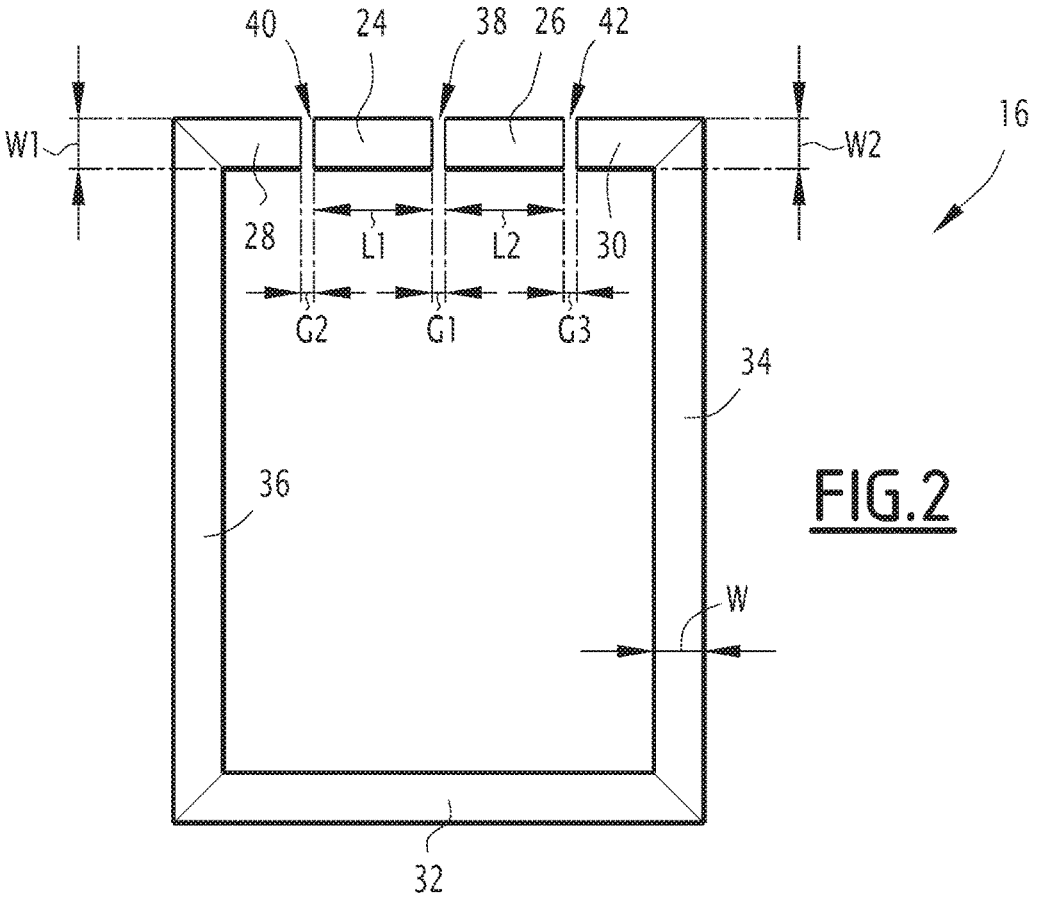
FIG. 2 is a schematic view of the fastening element of FIG. 1.

In the example of FIG. 2, the fastening element 16 comprises a first portion 24, a second portion 26, a third portion 28 and a fourth portion 30 which are configured to be disposed along a single side of the recess 14, such as a top side of the recess 14 when the support 12 is a wearable article of clothing or a backpack.

As an optional addition, the fastening element 16 comprises a fifth portion 32 configured to be disposed along an opposite side of the recess 14, such as a bottom side of the recess 14 when the support 12 is a wearable article of clothing or a backpack.

As a further optional addition, the fastening element 16 comprises a sixth portion 34 and a seventh portion 36, each one of the sixth and seventh portions 34, 36 being configured to be disposed along another respective side of the recess 14, such as a lateral side of the recess 14 when the support 12 is a wearable article of clothing or a backpack.

In the example of FIG. 2, several portions 24, 26 of the fastening element 16 have a respective length L1, L2 depending on the characteristic wavelength $\lambda_{antenna}$. In this example of FIG. 2, the first portion 24 has a first length L1, the second portion 26 has a second length L2 and each one of the first and second lengths L1, L2 depends on the characteristic wavelength $\lambda_{antenna}$.

The length L1, L2 depending on the characteristic wavelength $\lambda_{antenna}$ is preferably the greatest length of the corresponding portion 24, 26. In the example of FIG. 2, each portion 24, 26 with a length L1, L2 depending on the characteristic wavelength $\lambda_{antenna}$ has a rectangular shape and the first and second lengths L1, L2 each correspond to the length of the long side of the rectangle.

The length L1, L2 depending on the characteristic wavelength $\lambda_{antenna}$ is preferably substantially equal to a quarter of the characteristic wavelength $\lambda_{antenna}$ of the radioelectric antenna 20. The first length L1 of the first portion 24 is preferably substantially equal to the second length L2 of the second portion 26.

Accordingly, each one of the first and second lengths L1, L2 satisfies the following relation:

$$L \approx \frac{\lambda_{antenna}}{4} \tag{1}$$

where L is the length depending on the characteristic wavelength $\lambda_{antenna}$, and $\lambda_{antenna}$ is the characteristic wavelength of the radioelectric antenna 20.

In the example of FIG. 2, the first and second portions 24, 26 are separated by a first gap 38, the first and third portions 24, 28 are separated by a second gap 40 and the second and fourth portions 26, 30 are separated by a third gap 42. The first gap 38 has a first measure G1, the second gap 40 has a second measure G2 and the third gap 42 has a third measure G3.

The measure G1, G2, G3 of each gap 38, 40, 42 between two successive portions 24, 26, 28, 30 is comprised between 1 mm and 3 mm, preferably substantially equal to 2 mm. In other words, the distance between the first and second portions 24, 26, respectively between the first and third portions 24, 28, and respectively between the second and fourth portions 26, 30, is comprised between 1 mm and 3 mm, preferably substantially equal to 2 mm.

Figure 4:
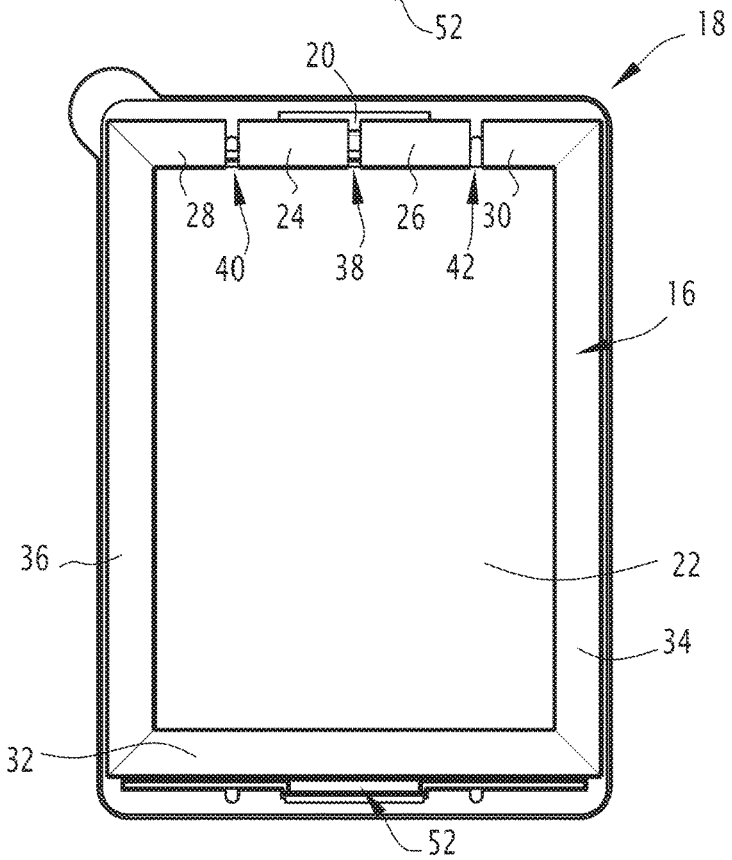
FIG. 4 is a schematic view representing the position of the fastening element with respect to the electronic module of FIG. 1.

The electronic module 18 comprises the radioelectric antenna 20 and the display screen 22, the display screen 22 being visible through the recess 14 when the fastening element 16 is fixed to the support 12 on one hand and fastened to the electronic module 18 on the other hand, as shown in FIG. 4.

The electronic module 18 is adapted to be mounted at the location of the recess 14 on the inside of the support 12. The electronic module 18 is preferably a flexible electronic module. An outer peripheral edge 44 of the electronic module 18 has a shape similar to that of the recess 14 with slightly larger external dimensions so as to provide around the interior of the support 12 around the recess 14 an overlapping peripheral region 46, as shown in FIG. 1. A width of the overlapping peripheral region 46 is substantially constant.

Figure 3:
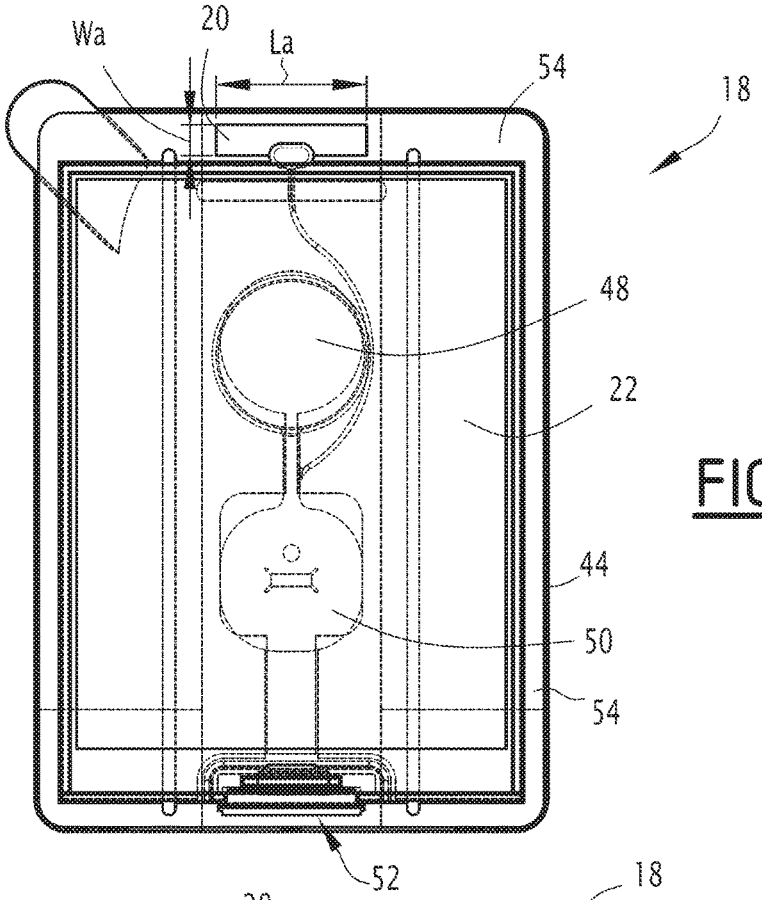
FIG. 3 is a schematic view of the electronic module of FIG. 1.

In FIG. 3, the electronic module 18 further comprises a battery 48 for stocking electric energy, an information processing unit 50 configured for processing information, in particular information to be displayed on the display screen 22, and an electric connector 52 for connecting the display screen 22 to the information processing unit 50 and to the battery 48. The information processing unit 50 is connected to the battery 48 for being provided with electric energy. The information processing unit 50 is connected to the radioelectric antenna 20, and includes a transceiver, not shown, for emitting information to a remote electronic device, not shown, and/or for receiving information from the remote electronic device or from another remote electronic device, not shown.

The electronic module 18 is preferably substantially planar.

The electronic module 18 further includes a magnetic frame 54 for being magnetically fastened to the fastening element 16, the magnetic frame 54 generating a magnetic field. In this example, the fastening element 16 is substantially perpendicular to the magnetic field generated by the magnetic frame 54.

The radioelectric antenna 20 is configured for emitting and/or receiving radio waves. The radioelectric antenna 20 is preferably a short distance radio-communication antenna. The radioelectric antenna 20 is for example a Bluetooth® antenna compliant with IEEE 802.15 standard, also called Bluetooth® standard, or a Wi-Fi™ antenna compliant with IEEE 802.11 standard, also called Wi-Fi™ standard.

The radioelectric antenna 20 is for example a single-band dipole-type element. The radioelectric antenna 20 has for example a bandwidth compliant with the Bluetooth® standard, such as a bandwidth substantially around 2.44 GHz. The radioelectric antenna 20 has for example a maximum gain of 2.05 dBi and an efficiency of −3 dB.

The radioelectric antenna 20 has for example a rectangular shape with a length La of substantially 36 mm and a width Wa of substantially 6 mm, in the plane of the electronic module 18.

The display screen 22 has dimensions identical to those of the recess 14, or very slightly higher, for example 5% or 10% higher, so that only an active surface of the display screen 22 is visible through the recess 14.

The display screen 22 is configured for displaying any kind of information, such as messages, logos, graphic signs, etc. The display screen 22 is for example an e-Paper Display, also called EPD. The display screen 22 is configured for displaying information in a similar manner as if this information has been printed on the front of the support 12, especially when the display screen 22 is an e-Paper Display whose reflective properties are close enough to those of a paper or a tissue. Alternatively, the display screen 22 is a LCD (Liquid Crystal Display) display screen or an OLED (Organic Light-Emitting Diode) display screen.

The portion(s) 24, 26 with a length L1, L2 depending on the characteristic wavelength $\lambda_{antenna}$ is (are) the portion(s) of the fastening element 16 which are closest to the radioelectric antenna 20, as shown in FIG. 4.

As an optional addition, the length L1, L2 depending on the characteristic wavelength $\lambda_{antenna}$ is the greatest length of the corresponding portion 24, 26 in a plane substantially parallel to the plane of the electronic module 18.

In the example of FIG. 2, the first portion 24 has a first width W1 smaller than the first length L1 and the second portion 26 has a second width W2 smaller than the second length L2. Accordingly, the length depending on the characteristic wavelength $\lambda_{antenna}$ for the first portion 24, and respectively for the second portion 26, is the first length L1, and respectively the second length L2.

In a plane substantially parallel to the plane of the electronic module 18, the first length L1 of the first portion 24 is preferably substantially equal to 24 mm. In this plane, the second length L2 of the second portion 26 is preferably substantially equal to 24 mm. The characteristic wavelength $\lambda_{antenna}$ is preferably substantially equal to 96 mm.

In a plane substantially parallel to the plane of the electronic module 18, the first width W1 of the first portion 24 is preferably substantially equal to 9 mm. In this plane, the second width W2 of the second portion 26 is preferably substantially equal to 9 mm. More generally, in this plane and in the example of FIG. 2, each portion 24, 26, 28, 30, 32, 34, 36 has a width W which is preferably substantially equal to 9 mm.

The portions 24, 26, 28, 30, 32, 34, 36 of the fastening element 16 are disposed around at least two sides of the recess 14. In the example of FIG. 2, the portions 24, 26, 28, 30, 32, 34, 36 of the fastening element 16 are disposed around the four sides of the recess 14, the first, second, third and fourth portions 24, 26, 28, 30 being disposed along the top side of the recess 14, the fifth portion 32 being disposed along the bottom side of the recess 14, and the sixth and seventh portions 34, 36 being disposed along the two lateral sides of the recess 14.

As an alternative, the portions of the fastening element 16 are disposed along only two or three sides of the recess 14. According to this alternative, the fastening element 16 includes for example only the first, second, third and fourth portions 24, 26, 28, 30 along one side of the recess 14, such as the top side, and the fifth portion 32 along another side of the recess 14, such as the bottom side, and does not include sixth and seventh portions.

Therefore, the fastening element 16 and the set 10 according to the invention, said set 10 comprising this fastening element 16 and the electronic module 18, allow an improvement of the data transmission via the radioelectric antenna 20.

Indeed with the gaps 38, 40, 42, also called openings, arranged in the fastening element 16 and with at least one portion 24, 26 of the fastening element 16 having a length L1, L2 depending on the characteristic wavelength $\lambda_{antenna}$ of the radioelectric antenna 20, the fastening element 16 forms a second dipole whose excitation frequency is substantially equal to the one of the first dipole formed by the radioelectric antenna 20, such as approximately 2.44 GHz.

Accordingly, this second dipole formed by the fastening element 16 will be excited by coupling to the radioelectric antenna 20, which therefore avows maintaining a good adaptation with the radioelectric antenna 20 and also transmission of the radio waves beyond the fastening element 16.

In other words, the gaps 38, 40, 42 arranged in the fastening element 16 and the at least one portion 24, 26 of the fastening element 16 having a length L1, L2 depending on the characteristic wavelength $\lambda_{antenna}$ allow a good radiation of the radioelectric antenna 20 despite the presence of the magnetic frame 54 and of the fastening element 16 which is preferably a metallic element, such as a metallic yarn element.

When two portions of the fastening element 16 have a length L1, L2 depending on the characteristic wavelength $\lambda_{antenna}$, such as the first portion 24 with the first length L1, the second portion 26 with the second length L2, and the first and second lengths L1, L2 both depending on the characteristic wavelength $\lambda_{antenna}$, the coupling of the fastening element 16 to the radioelectric antenna 20 is further improved.

The invention claimed is:

1. A fastening element for magnetically fastening an electronic module, the fastening element being configured to be fixed to a support, the support having a recess, the electronic module including a radioelectric antenna and a display screen, the radioelectric antenna having a characteristic wavelength, the display screen being visible through the recess when the fastening element is fixed to the support and fastened to the electronic module, the fastening element being configured to be fixed around the recess, wherein the fastening element comprises several portions, at least some portions being separate from each other by a respective gap for emission and/or reception of radio waves by the radioelectric antenna, and wherein at least one portion has a length depending on the characteristic wavelength.

2. The fastening element according to claim 1, wherein several portions of the fastening element have a respective length depending on the characteristic wavelength.

3. The fastening element according to claim 1, wherein the length depending on the characteristic wavelength is the greatest length of the corresponding portion.

4. The fastening element according to claim 1, wherein the length depending on the characteristic wavelength is substantially equal to a quarter of the characteristic wavelength of the radio antenna.

5. The fastening element according to claim 1, wherein each portion with a length depending on the characteristic wavelength has a rectangular shape.

6. The fastening element according to claim 1, wherein the measure of each gap between two successive portions is comprised between 1 mm and 3 mm.

7. The fastening element according to claim 1, wherein the fastening element is a metallic element.

8. The fastening element according to claim 7, wherein the metallic element is a metallic yarn element.

9. A set comprising:

a fastening element configured to be fixed to a support, the support having a recess;

an electronic module magnetically fastened to the fastening element, the electronic module including a radioelectric antenna and a display screen, the radioelectric antenna having a characteristic wavelength, the display screen being visible through the recess, wherein the fastening element is according to claim 1.

10. The set according to claim 9, wherein the portion(s) with a length depending on the characteristic wavelength is (are) the portion(s) closest to the radioelectric antenna.

11. The set according to claim 9, wherein the portions of the fastening element are disposed around at least two sides of the recess.

12. The set according to claim 9, wherein the electronic module is substantially planar and the length depending on the characteristic wavelength is the greatest length of the corresponding portion in a plane substantially parallel to the electronic module.

13. The set according to claim 9, wherein the electronic module includes a magnetic frame for being magnetically fastened to the fastening element, the magnetic frame generating a magnetic field, and wherein the fastening element is substantially perpendicular to the magnetic field generated by the magnetic frame.

14. The set according to claim 9, wherein the set further comprises the support having the recess.

15. The set according to claim 14, wherein the support is a yarn support.

16. The set according to claim 14, wherein the support is a wearable article of clothing.

* * * * *